US005489961A

United States Patent [19]

Burbury et al.

[11] Patent Number: 5,489,961

[45] Date of Patent: Feb. 6, 1996

[54] CHEMICAL DEVELOPER SENSING SYSTEM FOR FILM PROCESSORS

[76] Inventors: Robert L. Burbury, 38 W. Brindlewood Lne., Elgin, Ill. 60123; W. Scott Tobey, 1249 Barneswood Dr., Downers Grove, Ill. 60515

[21] Appl. No.: 42,614

[22] Filed: Apr. 2, 1993

[51] Int. Cl.[6] ..... G03D 3/02; G03D 13/00

[52] U.S. Cl. ..... 354/298; 354/299; 354/324

[58] Field of Search ..... 354/298, 299, 354/324, 319–323; 430/375, 398–400; 134/64 P, 64 R, 122 P, 122 R

[56] References Cited

U.S. PATENT DOCUMENTS

| | | | |
|---|---|---|---|
| 3,650,196 | 3/1972 | Hosoe et al. | 354/324 |
| 3,712,203 | 1/1973 | Kishi | 118/637 X |
| 3,876,116 | 4/1975 | Kushima et al. | 118/602 X |
| 3,995,959 | 12/1976 | Shaber | 354/298 |
| 4,023,193 | 5/1977 | Schröter et al. | 354/298 |
| 4,119,989 | 10/1978 | Carvalko et al. | 354/298 |
| 4,505,565 | 3/1985 | Tanaka | 354/299 |
| 4,650,308 | 3/1987 | Burbury | 354/299 |
| 4,937,178 | 6/1990 | Kobushi et al. | 430/375 |
| 4,952,958 | 8/1990 | Ohba et al. | 354/322 |
| 5,179,404 | 1/1993 | Bartell et al. | 354/320 |

*Primary Examiner*—D. Rutledge
*Attorney, Agent, or Firm*—Leydig, Voit & Mayer, Ltd.

[57] ABSTRACT

A sensing probe detects characteristics of the strength of developer solution in a film processor and provides a signal to a sensing circuit. The sensing circuit provides a signal that is thereafter processed or otherwise manipulated for providing an output signal to a display for indicating the strength of the developer solution. The sensing signal may also be used to provide compensation or other appropriate corrective action to the film processor in an integrated monitoring system.

18 Claims, 5 Drawing Sheets

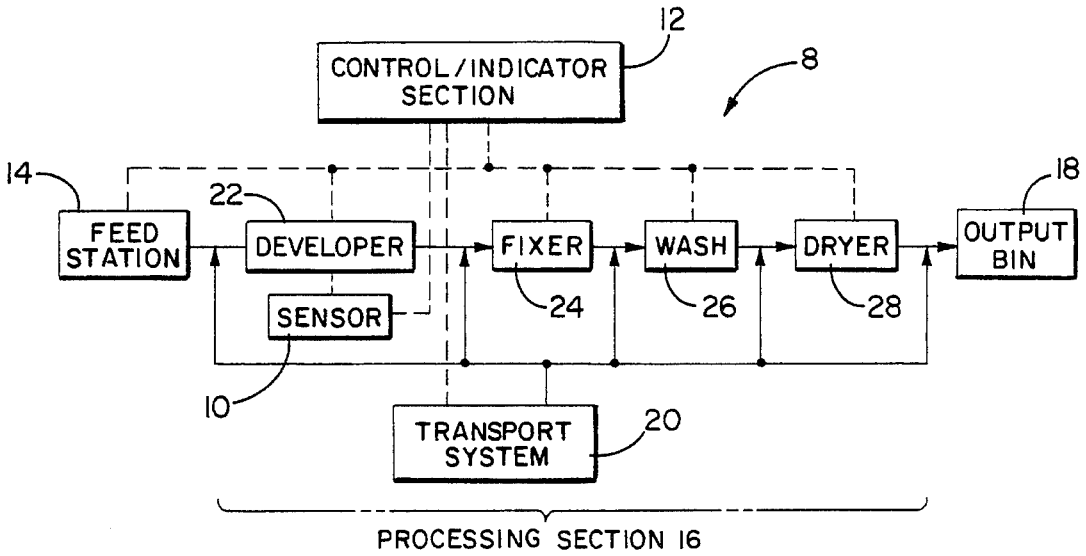
FIG. 1
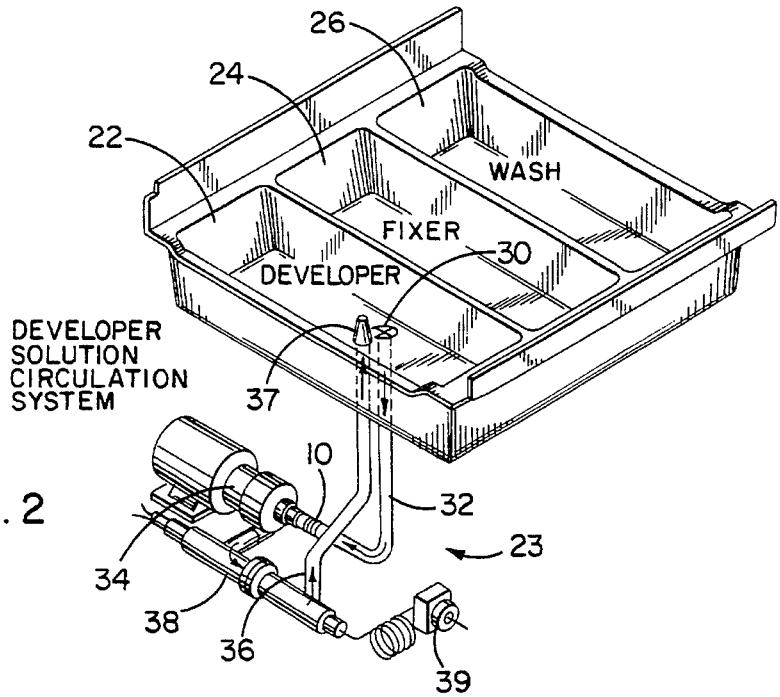
FIG. 2
FIG. 5
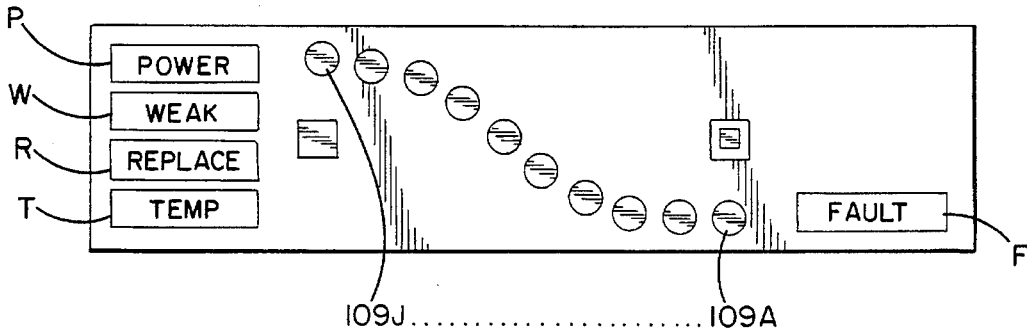

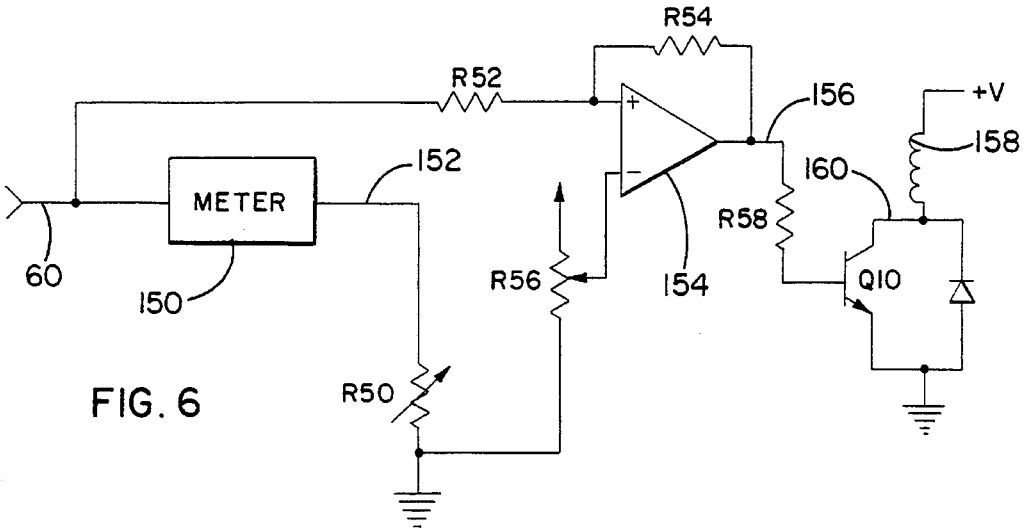
FIG. 6
FIG. 7
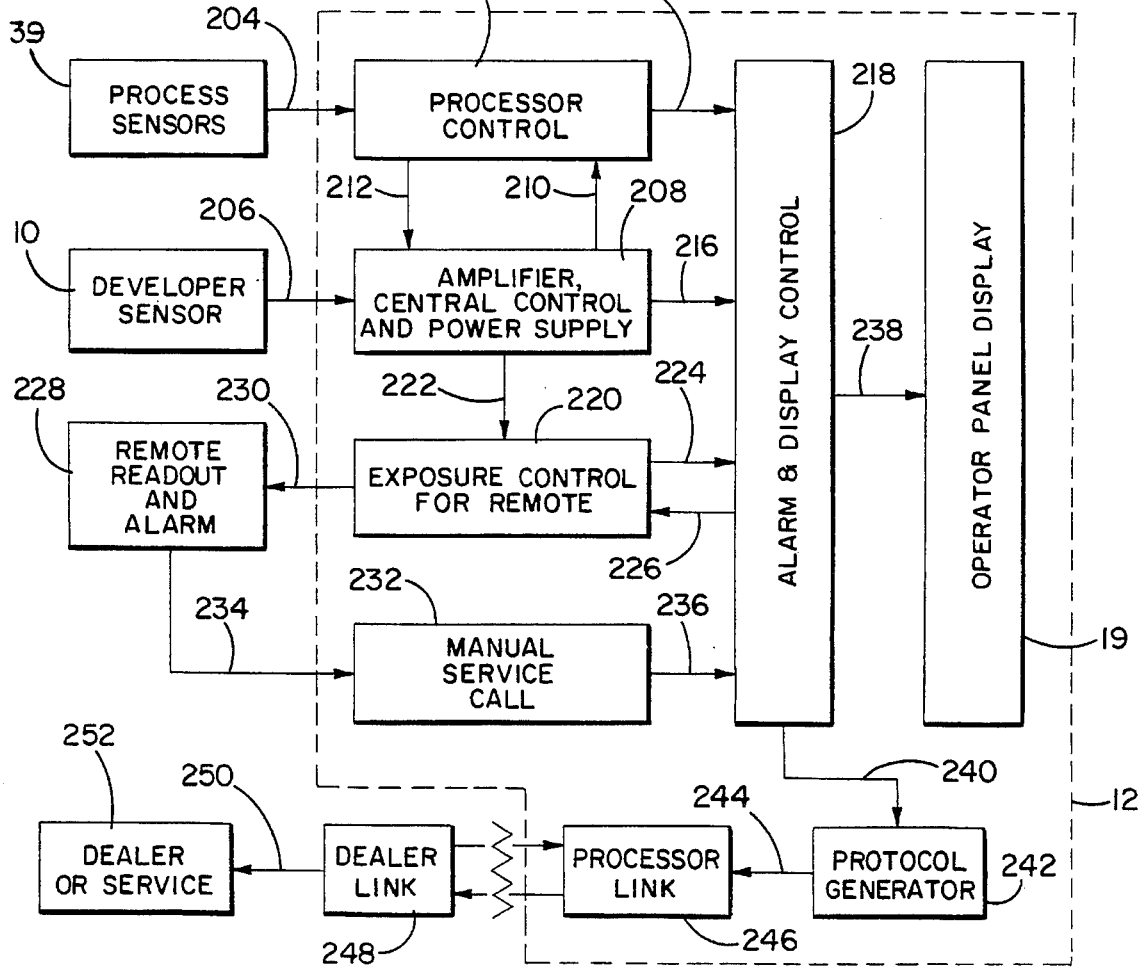

CHEMICAL DEVELOPER SENSING SYSTEM FOR FILM PROCESSORS

FIELD OF THE INVENTION

The present invention relates to the film processing art. More particularly, the present invention relates to the art and science of monitoring a film processor for developing film exposed to various forms of light, such as X-ray photons or visible light. Even more specifically, the present invention provides a developer solution sensor used in a film processor which provides an output signal indicative of the strength of the developer solution.

BACKGROUND OF THE INVENTION

Automatic film processors in commercial settings typically develop film exposed to various forms of energy ranging from X-ray to visible light. The energy is used to expose the film and create a latent image on the film which becomes visible during development. In the development process, the film is first immersed in developer solution. The film is thereafter passed through a fixer solution which preserves the visible image. The film is subsequently washed and dried by the processor so that it is available for viewing and analysis.

Such film processors, however, are susceptible to various difficulties arising from performance fluctuations during operation, particularly over extended periods of time. Principal among these difficulties is deteriorated or spent developer solution in the processor. The developer solution at full strength is typically yellowish in color; however, the coloration of the solution becomes dark brown over time due to oxidation of the developer solution. Inasmuch as quality of the visible image degrades over time as a function of aged developer solution, the need exists to accurately determine the developer solution strength. Deteriorated or weak processor chemicals affect the quality of the films developed and can result in reexposure of additional film. In the case of X-ray film processing, degraded developer solution frequently requires further patient exposure to radiation doses.

Conventional wisdom therefore dictates implementation of quality control programs to regularly check the film processor. Such programs typically use a quantity of film for sensitometric testing of the processor. A sensitometer exposes a test strip of film with a preselected light source. After the exposed strip is processed, a desensitometer is used to measure the various strips on the test film. This is accomplished by shining light through an image area on the film and measuring the amount of light passed through. These optical density values are then plotted and compared to data supplied from the film manufacturer to ensure proper development of the film.

Various types of self-cleaning X-ray film processors have also been proposed to deal, at least in part, with the problem of deterioration of developer solution, such as in Burbury U.S. Pat. No. 4,650,308, incorporated by reference herein. These processors employ a sequential cleaning cycle to periodically purge the various compartments of a film processor, including developer and fixer compartments. Thus, the developer strength is maintained through systemized cleaning and replenishment of the chemicals. However, these systems fail to adequately deal with monitoring of the developer solution in real time.

Other X-ray film processors have dealt with the problem of automatic exposure control, such as in U.S. Pat. No. 4,679,217. Adjustment of exposure control enables the X-ray technician to compensate for film density at the time of exposure when it is known that the developer strength of the processor has been decreased, but as of this time that has been essentially guess work.

SUMMARY OF THE INVENTION

Thus, the prior art film processor designs now offer unsatisfactory performance, at high cost with resulting image quality compromise, particularly in a commercial setting. Likewise, they provide an unacceptable and avoidable safety risk. Accordingly, a principal object of the present invention is to generally overcome deficiencies of the prior art.

More particularly, it is an object of the present invention to find improved image quality in a film processor.

It is an additional object of the present invention to provide a film processor that adequately addresses safety needs.

It is a further object of the present invention to monitor developer solution strength in a film processor, and provide compensation to the film processor when the developer strength in unacceptable.

The present invention provides these and other additional objects through an improved chemical developer sensing system used in a film processor, such as, for example, an X-ray film processor. Structurally, a preferred embodiment of the present invention comprises a chemical developer sensing probe disposed in developer solution utilized in an X-ray film processor. The sensing probe senses characteristics of the developer solution, for example, the coloration thereof, and develops a first sensing signal. The sensing probe is coupled with a sensing circuit which receives the first sensing signal and provides an enhanced sensing signal. In one exemplary embodiment, the sensing circuit thereafter provides the enhanced sensing signal to a control and output circuit. In addition, a temperature sensor senses the developer solution temperature and provides a second sensing signal to the control and output circuit. The control and output circuit provides an output signal to a display which displays indicia of the developer solution strength and/or temperature to a user. In this way the user may undertake appropriate action when the developer strength has diminished or is exhausted.

The chemical developer sensing probe may be integrated into an automatic self-correcting film processing system in other embodiments of the present invention. In one embodiment, the sensing circuit provides an output signal to actuate a pump for increasing replenishment of the developer solution in response to the first sensing signal. Likewise, the sensing signal may be supplied to a processor that provides appropriate control signals to a transport section of the processing system to adjust the transport speed. In addition, the processor may alter the exposure for the film at a remote x-ray generator to compensate for degraded developer solution. In yet another embodiment, the processor transmits information related to the first sensing signal and/or the second sensing signal via facsimile transmission or other digital transporting means to a remote location. In response, control signals are supplied to the processor or maintenance personnel are called for correcting the developer solution strength.

In another aspect of the invention, a method is provided for detecting the strength of developer solution relative to a preset level in a film processor. The film processor includes a sensing probe for sensing the chemical developer solution, a sensing circuit coupled with a sensing probe for providing a signal indicative of the chemical developer strength, and a control section for providing an output signal indicative of chemical developer strength. The method first senses the strength of the chemical developer and generates a sensing signal. The sensing signal is thereafter passed to the control section. The control section thereafter compares the sensing signal with a threshold value and passes an appropriate signal to a display for providing indicia of developer solution strength.

BRIEF DESCRIPTION OF THE DRAWINGS

FIG. 1 is a block diagram representation of a film processor which is suitable for use with a developer solution sensor according to the present invention.

FIG. 2 is a representative diagram illustrating a suitable placement of the developer sensor within the film processor of FIG. 1.

FIG. 5 illustrates a display used with the control and output circuit of FIGS. 4A and 4B.

FIG. 6 is an electrical schematic diagram of a control circuit for actuating a replenishment pump in accordance with another embodiment of the present invention.

FIG. 7 is a block diagram representation of the developer sensing circuit of FIG. 3 integrated in a film processor monitoring system according to the present invention.

DETAILED DESCRIPTION OF THE PREFERRED EMBODIMENTS

Figure 3:
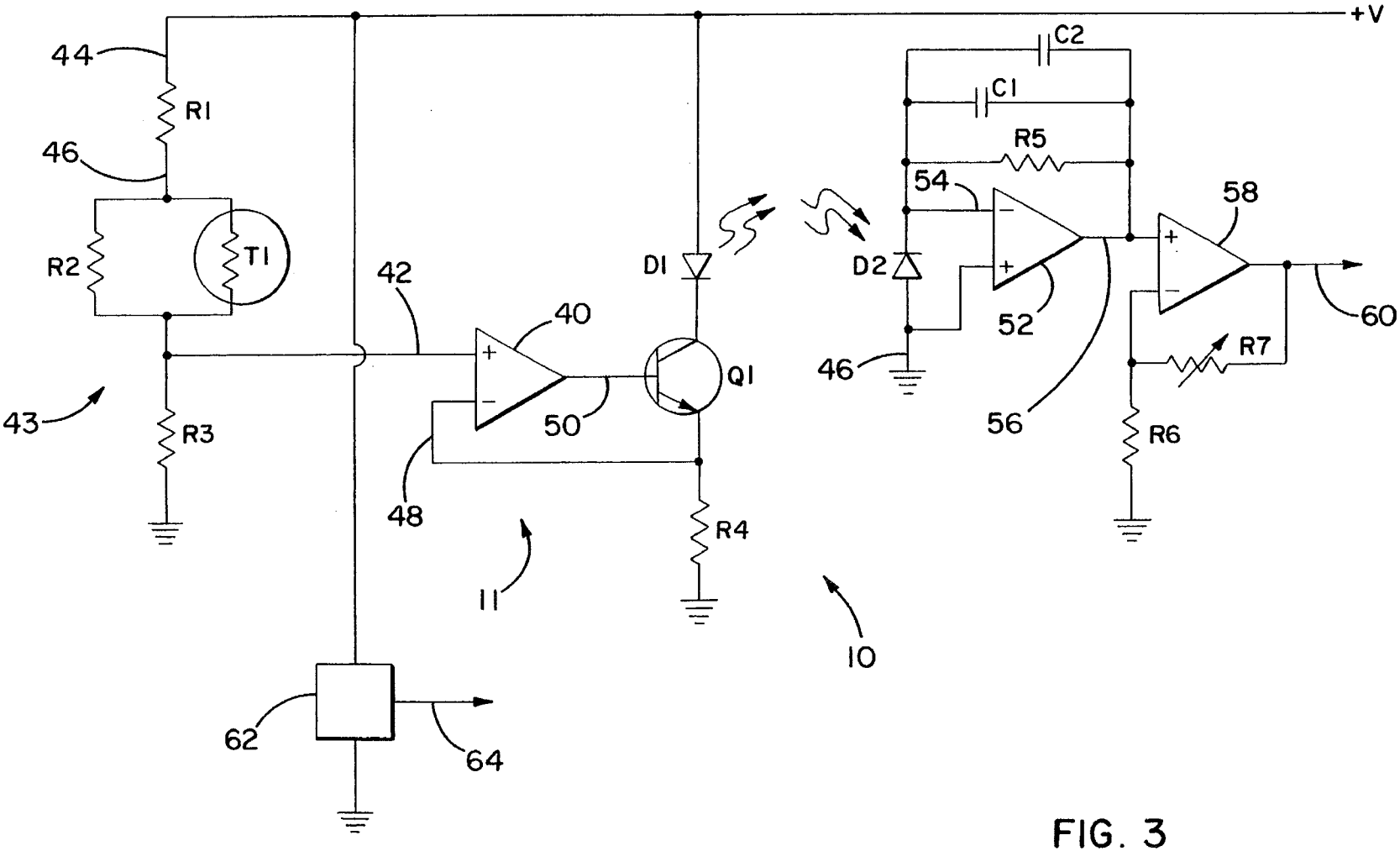
FIG. 3 is an electrical schematic diagram of the developer sensor and sensing circuit used in the film processor shown in FIG. 1 in accordance with one embodiment of the present invention.

Generally, the present invention provides improved monitoring of developer solution strength in processors for processing film exposed to various forms of energy, such as X-ray or visible light. The invention uses a sensing probe that detects characteristics of the strength of developer solution and provides a sensing signal that is thereafter passed to a control section of the film processor. The control section provides a signal for displaying indicia of the strength of the developer solution. The sensing signal may also be used to provide compensation or other appropriate corrective action to the film processor in an integrated monitoring system. In this way, the developer solution strength may be continuously monitored and replaced when appropriate, avoiding the risk of reexposure of additional film, and in the case of x-ray film processing, further patient exposure to radiation.

FIG. 1 shows a simplified block diagram of a generally conventional arrangement of the various sections constituting a film processor 8 suitable for using a developer solution sensor 10 according to the present invention. The film processor 8 includes a control/indicator section 12 which coacts with a feed station 14, a processing section 16 and an output bin 18. The control/indicator section 12 receives various sensing signals and provides overall machine control signals and current status information. As shown in FIG. 5, the control/indicator section 12 preferably includes a display 19 for displaying the developer solution strength and also developer solution temperature based on signals supplied from the developer solution sensor 10, as described in greater detail below. A variety of status indicators such as dryer temperature meters, monitors for developer and fixer levels, etc., may also be located on the display 19 as will be understood by those skilled in the art.

The feed station 14 of the processor initiates the transport of the film into the processor compartments. The feed station accepts exposed film and conveys it to a transport system 20, as will be understood by those skilled in the art.

The film is thereafter transported through the processing section 16 which includes the transport system 20 that controls the path of the film through the processor. The processing section 16 also includes a developer tank 22, a fixer tank 24, a wash tank 26 and a drying section 28 (see FIG. 2). The developer tank 22 holds a chemical solution that makes a latent image created on the exposed X-ray film visible during development of the film. At full strength, the developer solution is typically yellowish in color. Oxidation of the developer solution after extended periods of use weakens the developer solution and changes its color to a dark brown. Other parameters of the developer solution also change as the solution degrades. For example, the pH level, density, viscosity, conductivity and specific gravity of the developer solution change as well. Of course, weakened developer solution prevents film development of diagnostic quality, particularly in x-ray film processing.

The fixer tank 24 holds a chemical solution which functions to harden and preserve the visible or manifest image. The chemical solution within the fixer tank 24 has the property of halting the development cycle. The film, after it is passed through the developer tank, is exposed to the fixer solution and the visible image thereon is permanently stored or fixed, as is known by those skilled in the art.

The developed film then passes to the wash tank 22 which contains externally supplied water and functions to remove residue fixer solution from the processed film in order to prolong film as well as image storage life. The film is normally passed from the wash tank 26 through a series of squeegee rollers (not shown) that remove excess water in preparation for drying and provide a uniform squeezing motion in order to avoid drying artifact. The film thereafter passes into the dryer section 28 containing electrically controlled dryer which passes a constant temperature over the film exiting the wash tank before it is conveyed to the output receiving bin 18. Also associated with the main sections described above are other subsystems (not shown) such as the processor water supply system, the temperature regulations system, the chemical replenishment system, the solution recirculation system and the silver reclamation system as will be known by those skilled in the art.

FIG. 2 is a simplified diagrammetric representation of the film processor 8 with portions of the system removed for clarity. FIG. 2 illustrates the placement of the developer solution sensor 10 within the film processor 8. As shown therein, the developer section includes a developer solution circulation system 23 having a solenoid actuated drain valve 30 which permits developer solution to flow through flow tube 32. The developer solution sensor 10 is located along flow tube 32 proximate a recirculation pump 34 in the preferred embodiment. When the chemistry of the developer solution exceeds a predetermined threshold value, the pump 34 functions to recirculate a greater concentration of developer solution via flow tube 36 and inlet valve 37 to the developer tank 22. Also shown in FIG. 2 is a heater tube 38 that functions to maintain a desired temperature on the basis of process temperature sensor 39.

FIG. 3 is an electrical schematic diagram illustrating the developer solution sensor 10 in greater detail. As shown therein, the sensor 10 includes a constant current source 11 comprising an amplifier 40 that receives a constant positive voltage applied to its noninverting terminal 42 through a voltage divider circuit 43. Voltage divider circuit 43 comprises the combination of resistors R1 through R3 and thermistor T1. Resistor R1 has a first terminal coupled to a positive voltage source on a line 44 and a second terminal coupled to the parallel combination of resistor R2 and thermistor T1 on a line 46. Resistor R3 is connected between the second terminals of resistor R3 and thermistor T1 on line 42 and ground. The inverting terminal of amplifier 40 is connected via a line 48 to a first terminal of resistor R4 which, in turn, has its second terminal connected to ground.

The amplifier 40 applies a constant output voltage signal to the base of a transistor Q1 on a line 50. The emitter of transistor Q1 is connected via line 48 to resistor R4. A light-emitting diode D1 has its cathode connected to a constant positive voltage on the line 44 and its anode connected to the collector of transistor Q1. Thus, the output current of the collector of transistor Q1 is proportional to the voltage applied to the noninverting terminal of amplifier 40. In this way, a constant current is supplied to diode D1. The use of thermistor T1 compensates for drift of the current source due to fluctuations in temperature.

In the preferred embodiment, the light-emitting diode D1 is a type HLMP 3950, manufactured by Hewlett-Packard. The light-emitting diode D1 is packaged in a pyrex lens for enhanced developer solution sensing and emits green light in a wavelength range of 541 to 597. The light emitted by diode D1 passed through the developer solution and is detected by a light sensitive receptor diode D2. The light sensitive diode D2 is a type F 2506-02, manufactured by Hamumatsu, having its cathode connected to ground on the line 46 and its anode connected to the inverting terminal of a transimpedance amplifier 52 an a line 54. The light sensitive diode D2 generates a current sensing signal dependent on developer solution strength and passes it to the inverting terminal of amplifier 52. The noninverting terminal of amplifier 52 is coupled with ground on the line 46. A resistor R5 and capacitors C1 and C2 in parallel combination are coupled in a feedback path between the output terminal and inverting terminal of amplifier 52. In this way, noise detected in the sensed signal is suppressed.

The amplifier 52 supplies an output voltage signal on a line 56 to the noninverting terminal of a second amplifier 58. The inverting terminal of amplifier 58 is connected via resistor R6 to ground. A variable resistor R7 is connected as a feedback resistor between the output of amplifier 58 and the inverting terminal of amplifier 58 to provide an adjustable gain. In this way, an output voltage signal indicative of developer solution strength is provided on a line 60.

FIG. 3 also shows a temperature sensor 62 that provides an output sensing signal on a line 64 indicative of the developer solution temperature. Preferably, the temperature sensor is a type LM34 manufactured by National Semiconductor.

By way of example and not by way of limitation, the circuit components of the developer solution sensor and sensor circuit may have values as shown in the following Table I:

TABLE I

| Reference Numeral | Value, Type or Rating |
|---|---|
| 40,52,58 | LM 324 |
| R1 | 5.6 kohm |
| R2 | 3.9 kohm |
| R3 | 1 kohm |
| R4 | 100 ohm |
| R5 | 3.3 Mohm |
| R6 | 10 kohm |
| R7 | 100 kohm |
| T1 | 5 kohm |
| Q1 | 2N6531 |
| C1 | .01 microfarad |
| C2 | 1 microfarad |
| 62 | LM 34 |

Figure 4A:
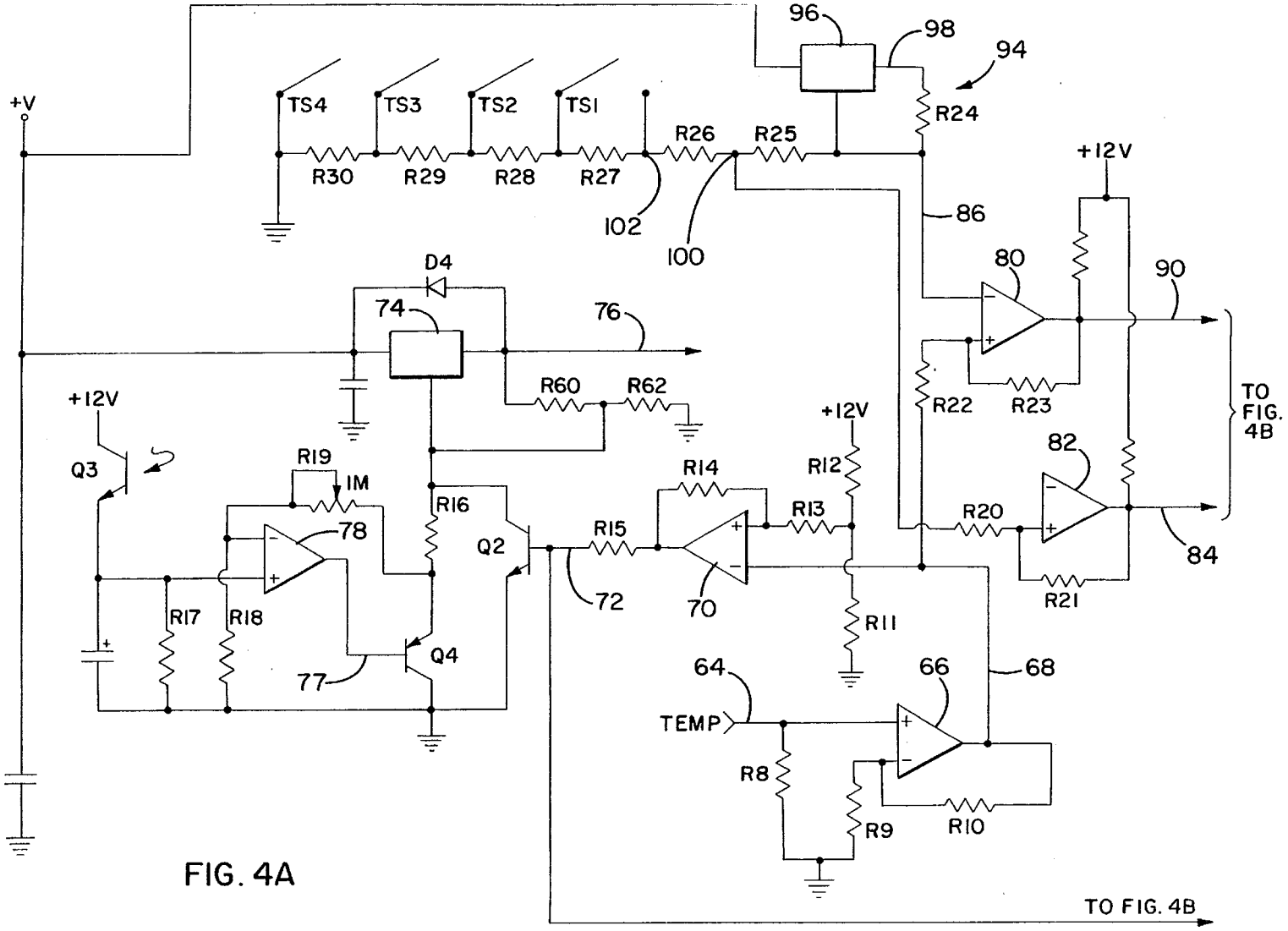
FIGS. 4A and 4B depict an electrical schematic diagram of a suitable control and output circuit suitable for use in conjunction with the developer sensor and sensing circuit of FIG. 3.
Figure 4B:
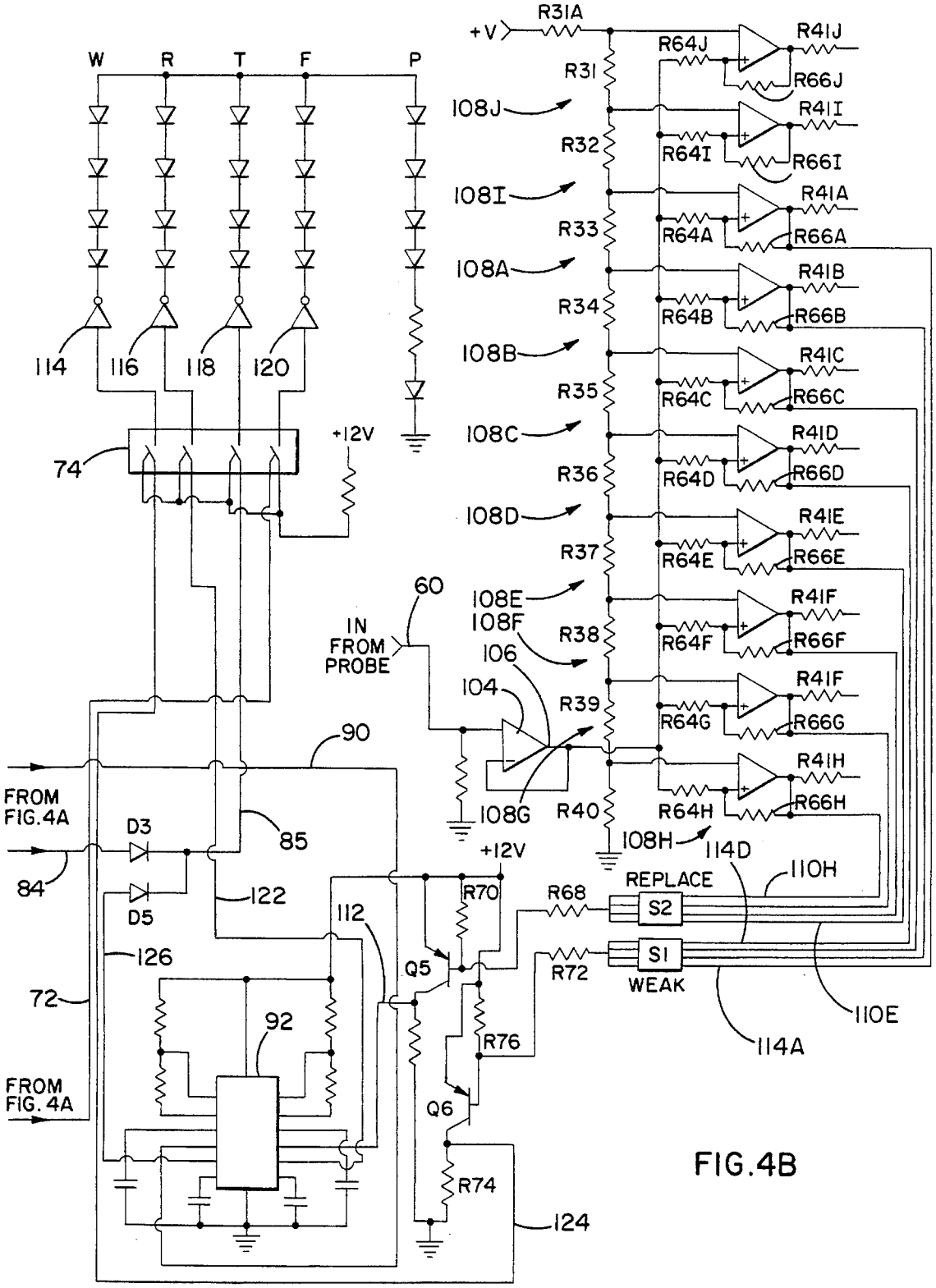

FIGS. 4A and 4B illustrate suitable output and control circuitry according to one embodiment of the present invention. As shown in FIG. 4A, the temperature sensing signal developed on line 64 is provided to the noninverting input terminal of a precision operational amplifier 66. A resistor R8 is connected between the noninverting input terminal of amplifier 66 and ground. Likewise, resistor R9 is connected between the inverting input terminal of amplifier 66 and ground. A feedback resistor R10 is placed between the output terminal of amplifier 66 and the inverting input terminal. Thus, an amplified temperature signal is provided on a line 68.

The temperature signal on line 68 is supplied to the inverting input terminal of comparator 70. A threshold voltage indicative of a fault condition is applied to the noninverting input terminal of comparator 70 via resistors R11 and R12 and the noninverting input terminal of comparator 70. A resistor R13 is connected between the junction of resistors R11 and R12. Likewise, a resistor R14 is connected between the output terminal of comparator 70 and its noninverting input terminal. When the signal supplied to the inverting input terminal of comparator 70 on line 68 is less than the threshold voltage, an output voltage signal indicative of a fault condition is developed via limiting resistor R15 on a line 72. The signal on line 72 is supplied to display circuitry, and particularly to a first input of a bilateral switch 74 (See FIG. 4B). The output terminals of bilateral switch are coupled via inverters 114–120 to indicator light emitting diodes on the display (denoted by the letters W, R, T, F and P). In this condition, indicator light emitting diodes W, R, T, F and P are turned off.

In addition, the signal on line 72 is supplied to the base of transistor Q2 which has its collector connected via resistor R16 to the adjustment terminal of a voltage regulator 74. In the preferred embodiment, voltage regulator 74 supplies an output voltage for driving the display indicator lights W, R, T, F and P on a line 76. Accordingly, when a voltage signal indicative of a system fault condition is developed on line 72, the indicator lights on the display are blanked. However, if the temperature sensing signal supplied to the inverting terminal of comparator 70 exceed the threshold level, i.e., for normal operating conditions, the output signal on line 72 will appear as a low voltage.

The adjustment terminal of voltage regulator 74 is also controlled by the sensing of ambient light via phototransistor Q3 for adjusting the intensity of the display. Phototransistor Q3 has its collector connected to a constant positive voltage and its emitter connected to the noninverting input terminal of amplifier 78. A resistor R17 is connected between the noninverting input terminal of amplifier 78 and ground. A resistor R18 is likewise placed between the inverting input terminal and ground. A feedback resistor R19 is connected between the collector of transistor Q4 and the inverting input terminal amplifier 78. The output of amplifier 78 is connected to the base of transistor Q4 on a line 79. Resistor R60 is placed between the output and the adjustment terminal of voltage regulator 74. In addition, resistor R62 is placed between the adjustment terminal and ground. A diode D4 is placed between the input and output terminals of voltage regulator 74. This arrangement reduces the voltage applied to the adjustment terminal of voltage regulator 74 to increase the intensity of the display for increased ambient light.

The temperature signal on line 68 is supplied to the inverting input terminals a pair of comparators 80 and 82 that provide an output to the display circuitry for operation exceeding a selected temperature operating window. In particular, a threshold voltage is applied to the noninverting input terminal of comparator 82 via resistor R20, as described below. A feedback resistor R21 is placed between the output and the noninverting input of comparator 82. Accordingly, when the signal on line 68 does not exceed the threshold voltage applied to the noninverting terminal of comparator 82, an output signal is supplied to the display circuitry on line 84. As shown in FIG. 4B, the signal on line 84 is supplied via diode D3 to a third input of bilateral switch 74. As described below, the temperature indicator lamp T remains "on" for this condition.

In addition, the temperature sensing signal on line 68 is supplied via limiting resistor R22 to the noninverting input terminal of comparator 80. A feedback resistor R23 is placed between the output and the noninverting input terminal of comparator 80. A threshold voltage is likewise applied to the inverting input terminal of comparator 80 on a line 86. When the temperature sensing signal applied to the noninverting input terminal of comparator 80 exceeds the threshold value, an output signal is provided on a line 90 to a counter circuit 92. In response, the counter circuit applies an output signal on a line 126 via diode D5 to the third input terminal of bilateral switch 74 in order to blink the temperature indicator light T.

The threshold voltages applied to comparators 80 and 82 indicative of the upper and lower temperature limits are determined by a voltage divider circuit 94 shown in FIG. 4A. As shown therein, a voltage regulator 96 supplies an output voltage on line 98. The output voltage is applied across resistor R24 which has its terminals connected to line 98 and line 86. In addition, a resistor R25 is connected between the inverting input terminal of comparator 80 and the noninverting input terminal of comparator 82 via lines 86 and 100, respectively. In addition, a resistor R26 is connected between a terminal 102 and line 100. A series combination of resistors R27–R30 is connected between terminal 102 and ground. In addition, switches TS1–TS4 are connected across resistors R27–R30, respectively, in order to regulate the voltage level applied to comparators 80 and 82 which corresponds to a desired temperature level. In the preferred embodiment, the values of resistors R26–R30 are chosen to provide a temperature variation between 85° and 100° F. with a plus or minus two and one half degree window of operation.

FIG. 4B also illustrates display circuitry for displaying indicia relating to the developer solution sensing signal. As shown therein, the sensing signal on line 60 is applied to the noninverting input terminal of a buffer 104. The inverting input terminal is coupled with the output of buffer 104 on a line 106. An output signal on line 106 is applied to each of the noninverting input terminals of a bank of comparator circuits 108A–J. The threshold voltages for the comparator circuits 108 are provided by a reference voltage which is divided through resistors R31–R40. In this way, a stepped threshold voltage is applied to the inverting input terminal of each of the comparator circuits 108. Resistors R64A–J are coupled to the line 106 and each of the noninverting input terminals of comparators 108, respectively. Likewise, feedback resistors R66A–J are coupled between the outputs and the noninverting inputs of comparators 108, respectively. Thus, for example, when the voltage appearing on line 106 exceeds the threshold voltage applied to the inverting input terminal of comparator circuit 108A, an output signal is provided via resistor R41A to display an indicator light 109A of a 10 dot LED display (Se FIG. 5). Each of the remaining comparator circuits operate in the same fashion.

In addition, the output signals developed by each comparator circuit are provided to the indicator light circuitry. As an example, the output signal developed by comparator circuit 108H is provided on line 110 to the base of transistor Q5 via resistor R68. Transistor Q5 has its emitter coupled to a positive voltage. A resistor R70 is coupled between the positive voltage and the base of transistor Q5. In this way, a signal is applied on a line 112 to the counter circuit 92. In response, the counter circuit 92 provides an output signal to actuate the replace indicator light R on a line 122. A toggle switch 52 may be employed to select a desired output from comparator circuits 108E–H to thereby adjust the sensitivity of actuation the Replace indicator light R.

In a similar fashion, an output signal developed by one of the comparator circuits 108A–D is provided on line 114 via resistor R72 to the base of transistor Q6. Transistor Q6 has its emitter coupled to a constant positive voltage and its collector coupled via resistor R74 to ground. A resistor R76 is placed between the constant positive voltage and the base of transistor Q5. Accordingly, a signal is provided on a line 124 to the bilateral switch circuitry 74 for an appropriate display of the Weak indicator light W.

By way of nonlimiting example, the circuit components for the output and display circuitry may have values as shown in Table II:

TABLE II

| Reference Numeral | Value, Type or Rating |
|---|---|
| 66 | TLE 2021C |
| 70, 78, 80, 82, 104 | LM 358 |
| R8, R9 | 22 kohm |
| R10 | 97.6 kohm |
| R11 | 33 kohm |
| R12 | 68 kohm |
| R13 | 47 kohm |
| R14 | 4.7 Mohm |
| R15 | 3.3 kohm |
| R16, R31–R41 | 1 kohm |
| R17, R18, R64A–J, R68–R76 | 10 kohm |
| R19, R66A–J | 1 Mohm |
| R20, R22 | 4.7 kohm |
| R21, R23 | 1 Mohm |
| R24 | 221 ohm (1%) |
| R25 | 86.6 ohm (1%) |
| R26 | 1430 ohm (1%) |
| R27 | 140 ohm (1%) |
| R28 | 69.8 ohm (1%) |
| R29 | 34.8 ohm (1%) |
| R30 | 17.4 ohm (1%) |
| R60 | 220 ohm |
| R62 | 1.8 kohm |
| 74 | 4066 |

TABLE II-continued

| Reference Numeral | Value, Type or Rating |
|---|---|
| 114, 116, 118, 120 | 2804A |
| Q2, Q5, Q6 | 3906 |
| Q3 | OP 598 |
| 96 | 317 |
| D3–D5 | 4001 |

FIG. 5 illustrates a display used in conjunction with the output and display circuitry of FIGS. 4A and 4B. As shown therein, a power indicator light P is "on" when power is sensed by the system. A weak indicator light W is "on" when the developer condition reaches a preset weak level. A replace indicator light R flashes when the developer solution reaches a preset replace level. A temperature indicator T remains "on" when the temperature falls below a preset range. The temperature indicator light T flashes when the temperature is above the preset range. In addition, a 10 dot LED display 109A–F indicates the relative condition of the developer solution. A fault indicator light F is "on" when a system fault is detected.

FIG. 6 illustrates a second embodiment for displaying information concerning the color density of the developer solution. As shown therein, the sensing signal developed on line 60 may alternatively be supplied to an analog meter denoted by a block 150. A user may monitor the meter for taking corrective action. The analog meter 150 is preferably also coupled to a potentiometer R50 on a line 152 for calibration adjustment of meter deflection as will be understood by those skilled in the art. In this embodiment, the sensing signal on line 60 is also supplied via a resistor R52 to the noninverting input terminal of comparator 154. A feedback resistor R54 is connected between the output and the noninverting input terminal of comparator 154. A threshold voltage is supplied to the inverting input terminal of comparator 154 via resistor R56 which is coupled to a positive voltage.

When the signal applied to the noninverting input terminal of comparator 154 fails to exceed the threshold voltage, an output signal is developed on line 156. This output signal is supplied through a resistor R58 to the base of transistor Q10. The transistor Q10 has its emitter connected to ground and its collector coupled with an input terminal of a pump relay coil 158 on a line 160. The other terminal of pump relay coil 158 is connected to a positive voltage. Accordingly, when transistor Q10 switches on when the signal is applied to the base of transistor Q10 to energize the pump relay coil 158 and thereby actuate the recirculating pump 34 (See FIG. 2). In this way, the film processor 8 automatically replenishes the developer solution. Of course, this feature may be used in conjunction with the control and output circuitry of FIGS. 4A and 4B with appropriate modification thereof as will be understood by those skilled in the art.

The chemical developer sensor 10 according to the present invention may be readily integrated into a monitoring system, as shown in FIG. 7. The control section 12 in the monitoring system includes a panel display 19 as described above in conjunction with FIG. 5. The control section 12 receives sensing signals from process sensors in the film processor 8 such as the transport speed, replenisher pump cycling and other sensing signals as will be understood by those skilled in the art. These signals are passed to a processor control section 202 on a line 204. Likewise, the developer sensor 10 provides sensing signals indicative of developer solution strength and developer solution temperature on line 206 to a central control section 208. The central control section 208 also supplies and receives control and data signals from the processor control section 202 on the lines 210 and 212, respectively. In response, the processor control section 202 provides appropriate control signals to the transport system 20 (See FIG. 1) for adjusting transport speed and/or other system parameters. The processor control section 202 and the central control section 208 also provide output signals to an alarm and display control section 218 on lines 214 and 216, respectively. For example, the processor control section 202 supplies an alarm signal for service call on the line 214. In addition, the central control section 208 provides control signals to a remote exposure control section 220 on a line 222. In response thereto, the remote control section 118 provides and receives signals from the alarm displaying control section 218 on the lines 224 and 226.

The remote control section 220 also supplies data and control signals to a remote readout and alarm portion 228 via line 230 indicative of film density. The remote readout and alarm section 228 is typically located proximate an x-ray generator or other location convenient to a technician. The remote readout and alarm section 228 thereafter supplies data to a manual service call control portion 232 on a line 234. The manual service call control section 232 thereafter supplies control signals to the alarm and display control section 218 on a line 236.

The alarm and display control section 218 operates in a logical fashion in response to signals received from the processor control section 202, the central control section 208, the remote exposure control section 220 and the manual service call control section 232 to provide output signals to the display 19 on a line 238. Likewise, the alarm displaying control section 218 provides output signals on a line 240 to a protocol generator section 242. The protocol generator section 242 supplies signals on a line 244 to processor link 246 which is coupled with a remote link 248 at a dealer or a service station. The remote link 248 supplies appropriate information on a line 250 to notify a dealer or service personnel of desired parameters of the processing system, and developer solution strength.

Accordingly, a film processor with a sensor for detecting developer solution strength meeting the aforestated objectives has been described. The sensor measures the density of developer solution and provides a sensing signal which is thereafter processed such that the developer solution strength can be displayed. The developer sensor also includes a temperature sensor that provides a temperature sensing signal that is displayed or otherwise utilized in an integrated monitoring system. The invention is not limited to the particular embodiments described herein since other embodiments will occur to those skilled in the art to which this invention pertains, particularly upon consideration of the foregoing teachings.

What is claimed is:

1. Apparatus for monitoring the strength of developer solution used in an X-ray film processor comprising:

developer solution sensing means for sensing the optical density of a selected range of wavelengths of the developer solution and providing a sensing signal;

sensing circuit means coupled with said developer solution sensing means for receiving said sensing signal and for providing a first output signal; and display means for receiving said first output signal and for providing indicia of the developer solution strength in response to said first output signal.

2. The invention of claim 1 wherein said developer solution sensing means comprises:

current source means for providing a constant current;

light emitting diode means coupled with said current source means for passing light through at least a portion of developer solution; and photosensing means for detecting light passed through said portion of developer solution and for developing said sensing signal.

3. The invention of claim 1 further including:

temperature sensing means for sensing the temperature of said developer solution and for providing a temperature sensing signal, said output circuit means including means for receiving said temperature sensing signal, for comparing said temperature sensing signal with a threshold value, and for providing a third output signal when said temperature sensing signal exceeds said threshold value.

4. The invention as in claim 1 wherein at least a portion of said developer solution sensing means is packaged in a lens.

5. The invention as in claim 1 further including an output circuit for receiving said first output signal, for comparing said first output signal with a preselected threshold value and for providing a second output signal to said display means when said first output signal exceeds said threshold value.

6. Apparatus for monitoring the strength of developer solution used in an X-ray film processor comprising:

a developer solution sensor for sensing the discoloration of the developer solution and providing a sensing signal indicative of a selected range of wavelengths passed by the developer solution;

a sensing circuit coupled with said developer solution sensor for receiving said sensing signal and for providing a first output signal;

an output circuit for receiving said first output signal, for comparing said first output signal with a preselected threshold value and for providing a second output signal when said first output signal exceeds said threshold value; and a display coupled with said output circuit for receiving said second output signal and for providing indicia of the developer solution strength.

7. The invention of claim 6 wherein said developer solution sensor comprises:

a current source for providing a constant current;

light emitting diode means coupled with said current source for passing light through at least a portion of developer solution; and photosensing means for detecting light passed through said portion of developer solution and for developing said sensing signal.

8. The invention of claim 6 further including:

a temperature sensor for sensing the temperature of said developer solution and for providing a temperature sensing signal, said output circuit including means for receiving said temperature sensing signal, for comparing said temperature sensing signal with a threshold value, and for providing a third output signal when said temperature sensing signal exceeds said threshold value.

9. The invention as in claim 6 wherein the display provides a digital graphical representation of the developer solution strength.

10. The invention as in claim 6 wherein the display comprises an analog meter that provides meter deflection corresponding to developer solution strength.

11. The invention as in claim 6 wherein the developer solution sensor senses the discoloration of the developer solution without directly contacting the developer solution.

12. A film processor for developing X-ray film exposed to light, having automatic self-compensating capability, said processor comprising:

a developer section for holding a volume of developer solution including a developer solution sensing circuit that detects the color density of the developer solution within a selected range of wavelengths and provides a sensing signal;

a fixer section for holding a volume of fixer solution;

a wash section for holding a volume of wash solution;

a dryer section having means for drying the X-ray film;

each of said sections having a transport removably disposed within it and operative to accept the X-ray film at an input end and passing the film through the section to an output end;

separate means for automatically draining said developer, fixer and wash sections;

means for replenishing said developer, fixer and wash sections with their respective solutions; and a control circuit receiving said sensing signal and coordinating the sequence of operation of said draining, filling, circulating and transport in accordance with the sensed developer solution color density.

13. The film processor of claim 12 wherein said control circuit compares said sensing signal to a first preset value and inhibits said transport when said sensing signal is less than said first preset value.

14. The film processor of claim 13 wherein said control circuit compares said sensing signal to a second preset value and alters the speed of said transport when said sensing signal is less than said second preset value.

15. A method for detecting the relative strength of developer solution used in an X-ray film processor with a developer solution sensor, a sensing circuit coupled with the developer solution sensor, and a control and output circuit coupled with the sensing circuit, the method comprising:

sensing the degradation of the developing solution by detecting the discoloration thereof in a selected wavelength range with the developer solution sensor and providing a first sensing signal;

passing the first sensing signal to the sensing circuit and providing a enhanced sensing signal;

passing the enhanced sensing signal to the control and output circuit;

comparing the enhanced sensing signal to a preset value; and providing a first output signal when the enhanced sensing signal exceeds the preset value.

16. The method of claim 15 further comprising the step of transmitting the first output signal to a remote location.

17. The method of claim 15 further comprising sensing the temperature of the developing solution and providing a temperature signal;

passing the temperature signal to the control and output circuit; and providing an output signal indicative of the temperature of the developing solution.

18. A monitor for an X-ray film processor that uses developer solution comprising:

a developer solution sensor that monitors the strength of the developer solution, without directly contacting the developer solution, by passing selected wavelengths of light between a source and a receptor and generating an electrical signal at the receptor indicative of the light detected by the receptor; and an electrical circuit coupled with the receptor for comparing the electrical signal with a selected value and providing a warning signal to an output when the electrical signal does not exceed the selected value.

* * * * *